United States Patent [19]

Silverman et al.

[11] Patent Number: 4,799,034

[45] Date of Patent: Jan. 17, 1989

[54] VARACTOR TUNABLE COUPLED TRANSMISSION LINE BAND REJECT FILTER

[75] Inventors: Lawrence H. Silverman, Dix Hills; Randy Teague, Syosset; Richard Kaminsky, Dix Hills, all of N.Y.

[73] Assignee: General Instrument Corporation, New York, N.Y.

[21] Appl. No.: 112,285

[22] Filed: Oct. 26, 1987

[51] Int. Cl.[4] ..... H01P 1/203; H01P 1/20

[52] U.S. Cl. ..... 333/202; 333/204; 333/205; 333/235; 333/246

[58] Field of Search ..... 333/202, 204, 205, 206, 333/207, 109, 110, 129, 174, 223, 235, 245, 246, 12, 219; 334/41, 45, 15, 78; 331/96, 99, 107 SL, 107 C, 107 DP, 117 D

[56] References Cited

U.S. PATENT DOCUMENTS

| | | | |
|---|---|---|---|
| 3,864,824 | 2/1975 | Watson et al. | 29/608 |
| 4,121,182 | 10/1978 | Makimoto et al. | 333/205 |
| 4,283,694 | 8/1981 | Pauker | 333/34 |
| 4,383,227 | 5/1983 | de Ronde | 333/246 |
| 4,468,644 | 8/1984 | Teague et al. | 333/205 |

OTHER PUBLICATIONS

Torii et al–"Varactor–Tuned UHF Tuner Using Microstrip Lines", IEEE Trans. on Consumer Electronics, Feb. 1977; pp. 44-55.

*Primary Examiner*—Marvin L. Nussbaum

*Attorney, Agent, or Firm*—Kramer, Brufsky & Cifelli

[57] ABSTRACT

A tunable coupled transmission line band reject filter for use in the microwave frequency range includes a coupled transmission line having first and second line sections. Each line section has an input end and an output end. A transmission line exhibits a natural notch at a particular frequency. A first varactor is coupled between the input ends of the first and second sections. A second varactor is coupled between the output ends of the first and second sections. A D.C. bias voltage across the varactor diodes controls the center frequency of the resulting notch filter.

9 Claims, 2 Drawing Sheets

VARACTOR TUNABLE COUPLED TRANSMISSION LINE BAND REJECT FILTER

This invention relates to microwave hybrid circuits and more particularly, to a tunable coupled transmission line band reject filter operable at microwave frequencies.

Many electronic warfare systems, such as radar warning systems, include components (e.g., receivers) that can be rendered temporarily ineffective ("jammed") if an impinging signal is received that is powerful enough to saturate the component. In order to overcome this problem, tunable filters have been employed to block the jamming signal and permit normal operation of the system.

Various filters are known in the art for blocking jamming signals in radar warning systems and the like. For example, YIG (yttrium-iron-garnet) filters which are tuned in accordance with a current signal, are often used in microwave applications. Once the jamming signal is detected, the frequency of the detected signal is determined. Then, the YIG filter is tuned by means of a current control signal to block the detected jamming signal.

The conventional YIG filter requires a relatively long time to tune, normally on the order of milliseconds. Moreover, conventional YIG filters have a relatively large size and weight, characteristics which are particularly disadvantageous for airborne equipment.

It would be advantageous to provide a tunable coupled transmission line band reject filter that is compact and lightweight and which can be manufactured utilizing suspended line, microstrip, or stripline hybrid circuit fabrication techniques. It would be further advantageous if such a filter enjoyed a high speed tuning capability. The present invention relates to such a tunable band reject filter.

SUMMARY OF THE INVENTION

In accordance with the present invention, a tunable coupled transmission line band reject filter is provided for use in the microwave frequency range. A coupled transmission line has first and second line sections, with each section having an input end and an output end. The transmission line exhibits a natural notch at a particular frequency. A first varactor is coupled between the input ends of the first and second line sections. A second varactor is coupled between the output ends of the first and second line sections. Means are provided for biasing the first and second varactors with a D.C. voltage to change the capacitance thereof, thereby changing the frequency at which the natural notch occurs. The biased voltage can be coupled to the first and second varactors via first and second chokes, respectively.

The filter of the present invention can be fabricated using suspended line techniques. The suspended line structure exhibits low loss and enables placement of the varactors along the line. In the suspended line approach, a dielectric substrate is used having a top surface and a bottom surface. The first line section is located at the top surface of the substrate. The second line section is located on the bottom surface of the substrate in parallel with the first line section and in registration therewith. Means are provided for mounting the first varactor adjacent to the input ends of the first and second line sections. Means are provided for mounting the second varactor adjacent the output ends of the first and second line sections.

A filter in accordance with the present invention can also be fabricated using microstrip or stripline hybrid circuit techniques.

DETAILED DESCRIPTION OF THE INVENTION

Figure 1:
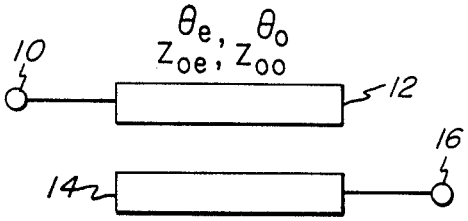
FIG. 1 is a schematic representation of a coupled transmission line having an arbitrary dielectric medium.

Coupled transmission lines are used in the transmission of signals at microwave frequencies. As shown in FIG. 1, such a transmission line comprises an input terminal 10 coupled to a first line section 12. The signal is propagated to a second line section 14 for output on an output terminal 16. As is well known in the art, such coupled transmission lines are described by specifying the even mode impedance $Z_{Oe}$ and the odd mode impedance $Z_{Oo}$ together with the length $\theta$. The length $\theta$ is a function of the frequency at which the transmission line is operated. For example, if line section 14 is 90° long ($\theta=90°$) at 5 gigahertz (GHz), then it will be 180° long at 10 GHz.

Coupled lines can also be used as D.C. blocking capacitors in microwave hybrid circuits. In fact, the structure of a coupled transmission line is similar to a parallel plate capacitor structure and the line therefore exhibits a capacitance between the first and second line sections. In experimenting with the use of coupled transmission lines as D.C. blocking capacitors, the inventors of the present invention noticed that in a frequency range not of interest, the transmission line exhibited a band reject notch. The existence of this notch can be confirmed from the equivalent circuits of the coupled transmission line shown in FIGS. 2*a* and 2*b*.

Figure 2A:
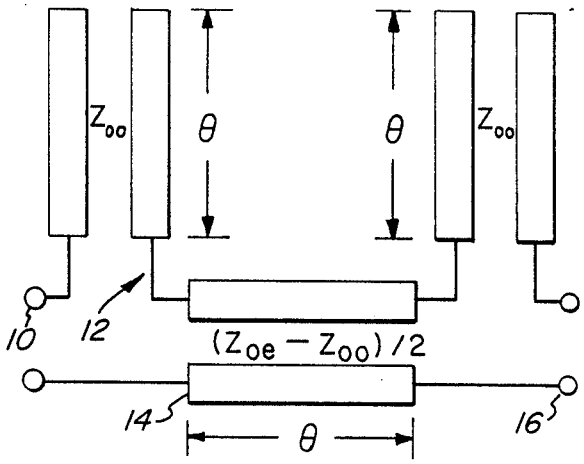
FIG. 2*a* is a schematic representation of an equivalent circuit of the coupled transmission line of FIG. 1 when a homogeneous dielectric medium is used.

As is apparent from the equivalent circuit of FIG. 2*a*, there is a band reject notch in the coupled transmission line for $\theta=\pi, 2\pi, 3\pi\ldots$, etc. The first notch at $\theta=\pi$ (i.e., 180°) is called the natural notch. A more complete discussion of the equivalent circuit of FIG. 2*a* is provided in the text "Microwave Filters, Impedance Matching Networks, and Coupling Structures", Mathaeii, et al, McGraw Hill, Copyright 1964, page 221, and is incorporated herein by reference.

Figure 2B:
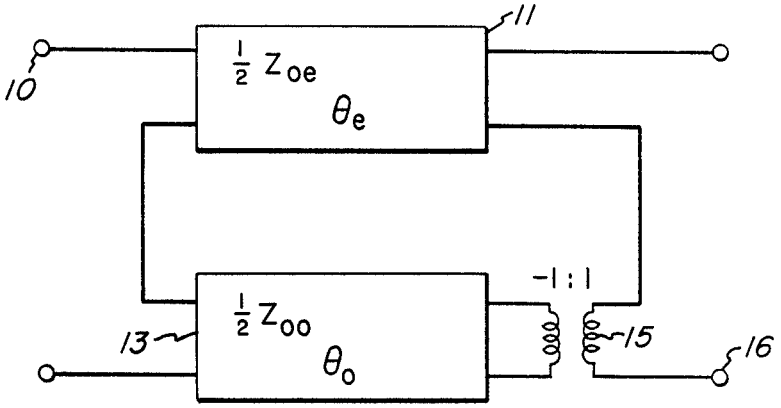
FIG. 2*b* is a schematic representation of an equivalent circuit of the coupled transmission line of FIG. 1 when an inhomogeneous dielectric medium is used.

FIG. 2*b* is an equivalent circuit for an inhomogeneous dielectric medium such as in the suspended line configuration illustrated in FIG. 4, discussed below. In the FIG. 4 embodiment, the dielectric medium 30 for $Z_{Oo}$ typically has a dielectric constant of about 2.2, whereas the dielectric medium 26, 28 for $Z_{Oe}$ (essentially air) has a dielectric constant of 1.0. This inhomogeneous structure also has a natural notch that can be derived mathematically from the ABCD matrix described in "Coupled Transmission Line Networks In An Inhomogeneous Dielectric Medium", G. I. Zysman and A. K. Johnson, *Transactions on Microwave Theory and Techniques,* Vol. MTT-17, No. 10, October, 1969, p. 755, which is incorporated herein by reference.

The equivalent circuit of FIG. 2*b* includes unit elements 11, 13, each of which represents a length of transmission line with specified electrical length and specified characteristic impedance. A polarity reversing transformer 15 is present at the output of the circuit. As indicated by the equivalent circuit, due to the transformer 15, the natural notch occurs when the unit element output voltages are equal.

Figure 3:
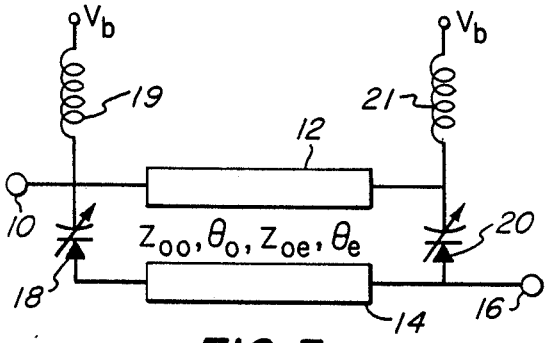
FIG. 3 is a schematic diagram of a varactor tunable coupled transmission line band reject filter in accordance with the present invention.

The present invention takes advantage of the natural notch to provide a tunable band reject filter. By changing the response of the coupled transmission line, the center frequency of the natural notch can be changed. In accordance with the present invention, the response of the coupled transmission line is modified through the use of high-Q varactors 18, 20 placed as shown in FIG. 3. Varactors are diodes having voltage-variable capacitance under reverse bias conditions. Thus, the filter of the present invention may be tuned by means of an easily generated voltage bias signal applied to the varactors.

In the circuit of FIG. 3, varactor 18 is coupled to the inputs of first and second line sections 12, 14, respectively. Varactor 18 is reverse biased by a bias voltage $V_b$ through a choke 19. Varactor 20 is coupled to the outputs of first and second line sections 12, 14 and is biased via a choke 21. Chokes 19 and 21 pass the D.C. bias voltage but block the microwave frequencies from the varactors 18, 20.

The bias level range will typically be from 0–30 volts, if an abrupt junction varactor diode is employed. If a hyperabrupt junction varactor diode is employed, the bias level will typically range between 0 and 20 volts. In the case where the band reject filter of the present invention is used in a radar warning apparatus, the bias voltage signal may be developed by detecting a jamming signal, converting the frequency of the jamming signal into a digital number by means of a conventional frequency to digital converter, and thereafter employing a digital to analog converter to generate the D.C. bias voltage signal which is a function of the frequency of the detected signal.

In a preferred embodiment, the band reject filter of the present invention can be fabricated using suspended line techniques. This structure is shown schematically in FIG. 4. First line section 12 is formed using conventional printed circuit techniques on the top surface of dielectric 30, such as that marketed by the Rogers Corporation under the registered trademark SF/DUROID. Second line section 14 is similarly formed on the bottom surface of dielectric 30. The coupled transmission line so formed is suspended in air 26, 28 between a top ground plane 22 and bottom ground plane 24. Varactors 18, 20 are mounted in electrical contact with second line 14 at their anodes, and wire bonded to first line section 12 at their cathodes.

Figure 4:
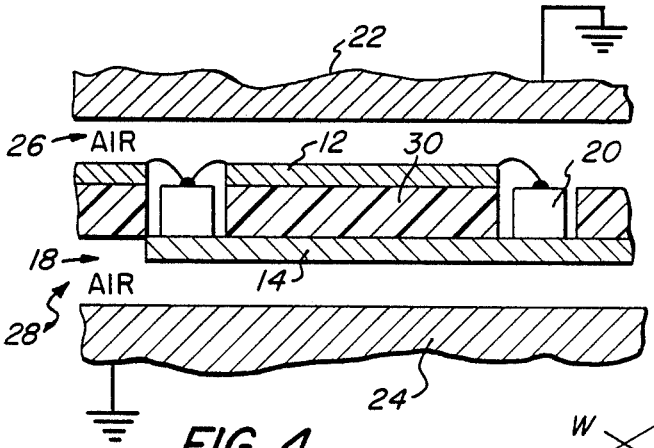
FIG. 4 is a cross-sectional diagram illustrating the varactor tunable coupled transmission line band reject filter of FIG. 3 fabricated using suspended line techniques.
Figure 5:
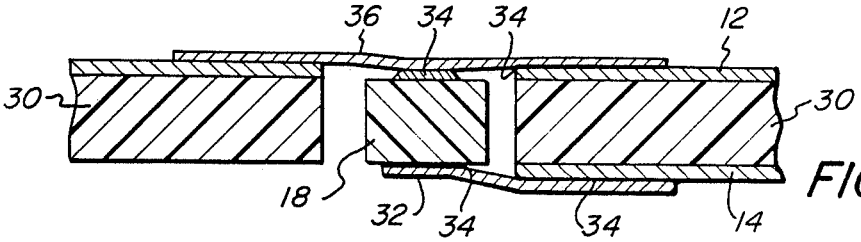
FIG. 5 is a partial detailed cross section showing the construction of the filter illustrated in FIG. 4.

FIG. 5 illustrates the physical structure of the suspended line band reject filter schematically illustrated in FIG. 4. First and second line sections 12, 14, respectively, are formed on dielectric 30. A gold ribbon 32 couples line section 14 to the anode of varactor 18 via solder or silver epoxy 34. Line section 12 is coupled by gold ribbon to the cathode of varactor 18 via solder or silver epoxy 34. Solder or silver epoxy 34 is also used to connect gold ribbons 32 and 36 to line sections 14 and 12, respectively. In the typical embodiment shown in FIG. 5, dielectric 30 comprises duroid 5880 and is 0.005 inches thick.

Figure 6:
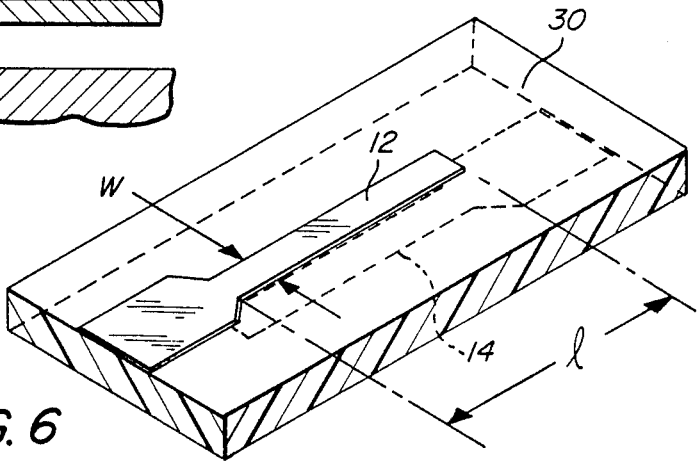
FIG. 6 is a perspective view illustrating the coupled transmission line of FIG. 1 fabricated on an insulating substrate.

FIG. 6 illustrates the coupled transmission line of FIG. 1 in perspective. First line section 12 having a width W and length L is etched on the top surface of dielectric 30. Second line section 14 is similarly etched on the bottom surface of dielectric 30.

In experiments conducted with a varactor tuned coupled transmission line band reject filter fabricated using suspended line techniques in accordance with the present invention, the center frequency of the notch filter was varied from 10.6 GHz to 12.02 GHz using a range of bias voltage from 5–20 volts. The 3 dB bandwidth of the notch varied from approximately 2 GHz to 2.3 GHz over this range. Those skilled in the art will appreciate that the structure of the present invention can be utilized to produce notch filters at other frequencies by varying the length and width of the coupled transmission line elements. It will also be appreciated that the band reject filter of the present invention can be alternately fabricated using conventional microstrip or stripline techniques.

While only a single embodiment of the present invention has been disclosed herein for purposes of illustration, those skilled in the art will appreciate that many variations and modifications can be made thereto, particularly with respect to the specific parameters of the components which may be selected in accordance with the results desired. It is intended to cover all of these variations and modifications that fall within the scope of the present invention, as defined by the following claims.

What is claimed is:

1. A tunable coupled transmission line band reject filter for use in the microwave frequency range comprising:

a coupled transmission line having first and second line sections, each line section having an input end and an output end, said transmission line exhibiting a natural notch at a particular frequency;

a first varactor coupled between the input ends of said first and second sections;

a second varactor coupled between the output ends of said first and second sections; and means for biasing said first and second varactors to change the capacitance thereof, thereby changing the frequency at which said natural notch occurs.

2. The filter of claim 1 further comprising:

a first choke coupling said biasing means to said first varactor; and a second choke coupling said biasing means to said second varactor.

3. The filter of claim 1 wherein said transmission line is a suspended line.

4. The filter of claim 3 wherein said suspended line comprises:

a dielectric substrate having a top surface and a bottom surface;

said first line section located on the top surface of said substrate;

said second line section located on the bottom surface of said substrate is parallel with said first line section and substantially in registration therewith;

means for mounting said first varactor adjacent the input ends of said first and second line sections; and means for mounting said second varactor adjacent the output ends of said first and second line sections.

5. A tunable band reject filter for use at microwave frequencies comprising:

a coupled transmission line having first and second straight-line sections coupled to each other and a natural band reject notch centered at a particular frequency;

first conductor means electrically connected to said first line section for inputting an input signal to said first line section;

varactor means coupled between said first and second line sections and adapted to receive a bias voltage for varying the center frequency of said notch, the change in center frequency being dependent on the magnitude of the bias voltage; and second conductor means electrically connected to said second line section for outputting the input signal after coupling through said transmission line.

6. The filter of claim 5 wherein said first and second line sections are supported on opposite surfaces of a flat dielectric.

7. The filter of claim 5 wherein said first and second line sections are fabricated using microstrip techniques.

8. The filter of claim 5 wherein said first and second line sections are fabricated using stripline techniques.

9. The filter of claim 5 further comprising choke means for coupling said bias voltage to said varactor means.

* * * * *